US007302898B1

(12) United States Patent
Martelli

(10) Patent No.: US 7,302,898 B1
(45) Date of Patent: Dec. 4, 2007

(54) QUILT HOLDING CLAMP AND METHOD OF USE

(76) Inventor: John D. Martelli, 321 S. 61st Ave., Pensacola, FL (US) 32506

( * ) Notice: Subject to any disclaimer, the term of this patent is extended or adjusted under 35 U.S.C. 154(b) by 0 days.

(21) Appl. No.: 10/449,167

(22) Filed: Jun. 2, 2003

(51) Int. Cl.
*D05B 11/00* (2006.01)
*D05B 35/02* (2006.01)
*D05B 35/06* (2006.01)

(52) U.S. Cl. ..... 112/119; 112/475.08

(58) Field of Classification Search ..... 112/117–119, 112/103, 136, 137, 138, 139, 141, 147–153, 112/475.01, 475.06, 475.08, 152; 24/499, 24/500, 502, 507, 511, 521, 522, 564; 38/102.1, 38/102.21, 102.91; 160/380, 382, 387, 402
See application file for complete search history.

(56) References Cited

U.S. PATENT DOCUMENTS 754,194 A * 3/1904 Buchanan ..... 24/327
1,937,491 A * 11/1933 May ..... 112/117
2,219,392 A * 10/1940 Jorgensen ..... 24/470
2,893,162 A * 7/1959 Knowles ..... 38/102.1
3,044,426 A * 7/1962 Schwarzberger ..... 112/117
5,802,677 A * 9/1998 Dorman et al. ..... 24/30.5 R
6,223,665 B1 * 5/2001 Hindsley ..... 112/117

* cited by examiner

*Primary Examiner*—Ismael Izaguirre

(57) ABSTRACT

A quilt holding clamp for securing a quilt and finishing bias to eliminate the need for pining when attaching the finishing bias to the unfinished edge of the quilt. The clamp includes a top clamp member having a "J"-shaped forward end for elevating a folded end of the finishing bias above the quilt. A bottom clamp member is provided with a "L"-shaped forward end. A "U"-shaped spring biases the "J"-shaped forward end and the "L"-shaped forward end together. The "L"-shaped forward end provides a recess for recessing multiple layers of the folded finishing bias.

20 Claims, 4 Drawing Sheets

QUILT HOLDING CLAMP AND METHOD OF USE

BACKGROUND OF THE INVENTION

1. Field of the Invention

The present invention relates to sewing aids and, more particularly, to a quilt holding clamp for aiding in the sewing of the finishing bias about the unfinished edges of a quilt.

2. General Background

Quilting is a past time enjoyed by many women young and old. Some women belong to quilting clubs where several women meet together to form quilts. Quilts are very popular for covering beds and throws over the back of sofas or other furniture.

While finishing bias for quilts can be sewn completely by machine, there are still many who prefer to hand stitch the folded end of the finishing bias to the quilt. One of the disadvantages of sewing the finishing bias is the need to pin the looped over finishing bias in place over the quilt. Pinning is tedious and time consuming. Since many older women quilt, arthritis can be a deterrent from quilting because of the need to pin the finishing bias.

As will be seen more fully below, the present invention is substantially different in structure, methodology and approach from that of other sewing aids.

SUMMARY OF THE PRESENT INVENTION

The preferred embodiment of quilt holding clamp of the present invention solves the aforementioned problems in a straight forward and simple manner.

Broadly, the present invention contemplates a quilt holding clamp for securing a quilt and finishing bias for said quilt comprising: a top clamp member having a "J"-shaped forward end for elevating a folded end of said finishing bias above said quilt and a back end; a bottom clamp member a forward end and a back end; and, a "U"-shaped spring biased to close together, about said quilt, said "J"-shaped forward end and said forward end of said bottom clamp member.

The present invention further contemplates a method of attaching a finishing bias to an unfinished edge of a quilt using a quilt holding clamp comprising the steps of: sewing the folded in half finishing bias to a first side of the quilt to create a seam and to attach a unfinished end of the finishing bias to the quilt; aligning the seam in a recess of a bottom clamp member of the quilt holding clamp wherein the recess is adapted to recess multiple layers of said finishing bias; feeding a folded end of said finishing bias in a channel of a top clamp member of the quilt holding clamp; and, sewing by hand the folded end of the finishing bias to the quilt.

In view of the above, a feature of the present invention is to provide a quilt holding clamp that is relatively easy to use.

Another feature of the present invention is to provide a quilt holding clamp that is relatively simple structurally and thus simple to manufacture.

A further feature of the present invention is to provide a quilt holding clamp that eliminates the need for pining the folded end of the finishing bias to a quilt.

The above and other features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
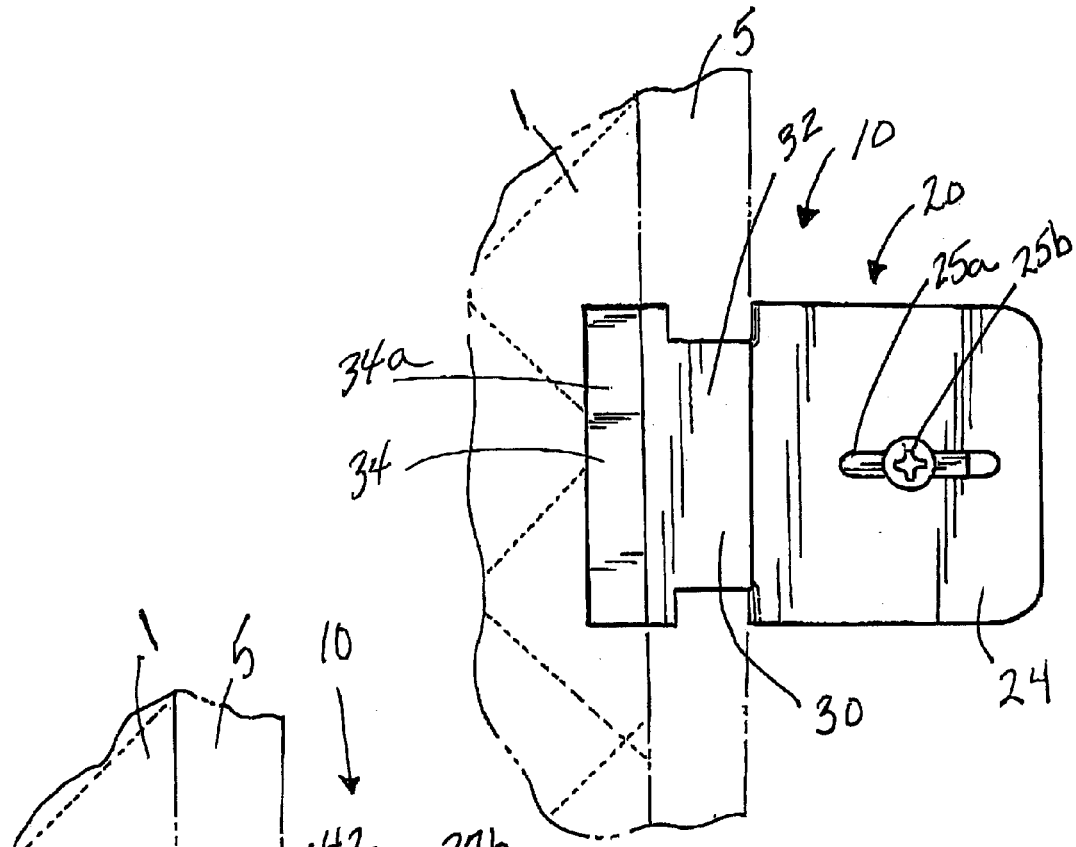
FIG. 1 illustrates a top plan view of the quilt holding clamp of the present invention holding a quilt and finishing bias.
Figure 2:
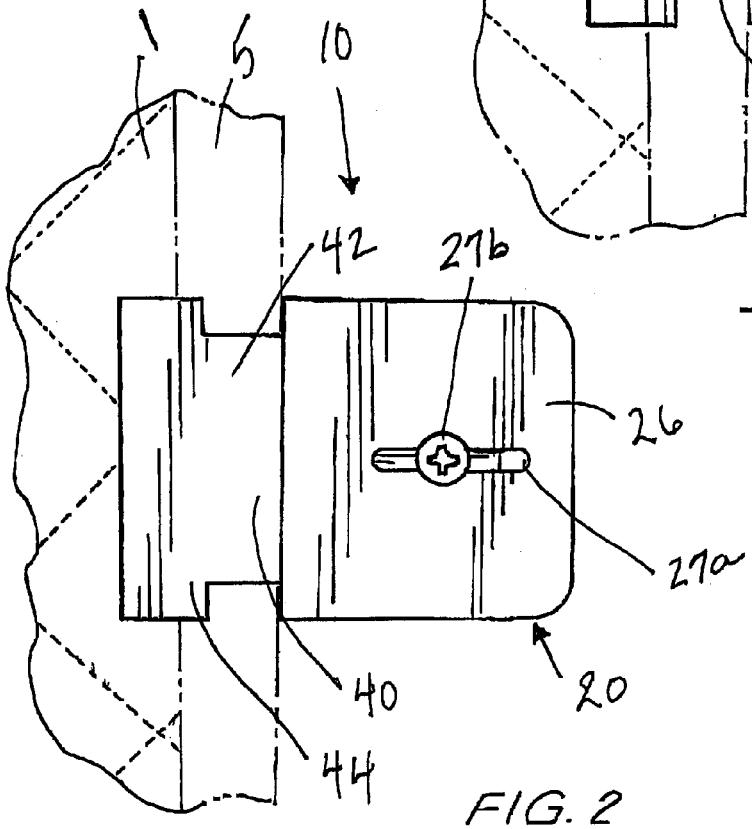
FIG. 2 illustrates a bottom plan view of the quilt holding clamp of the present invention holding a quilt and finishing bias.

Referring now to the drawings and in particular FIGS. 1-4 and 5A-5B, the quilt holding clamp of the present invention is generally referenced by the numeral 10. The quilt holding clamp 10 comprises, in general, a "U"-shaped spring 20 and a top clamp member 30 and a bottom clamp member 40. The top clamp member 30 and the bottom clamp member 40 are held in spatial relation from the other via the "U"-shaped spring 20.

Figure 3:
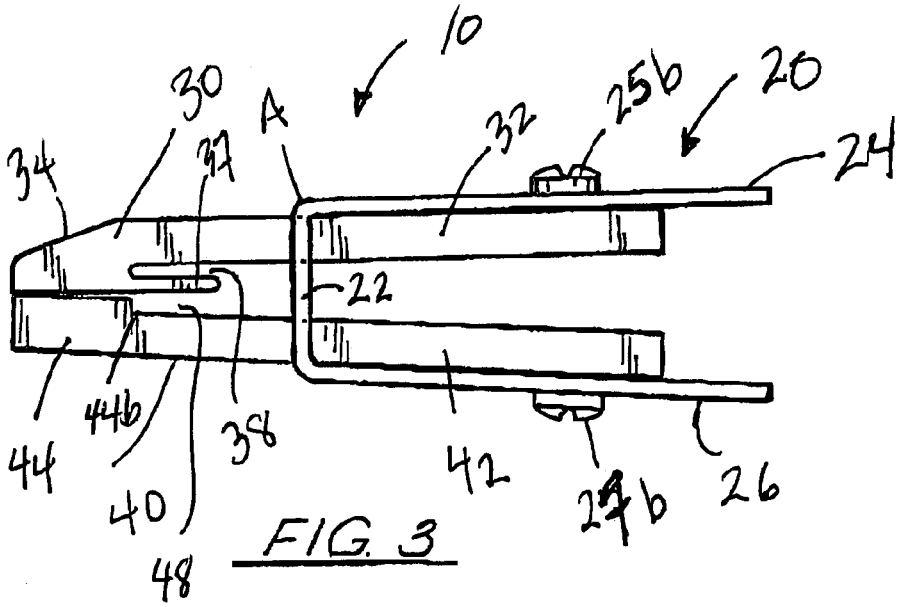
FIG. 3 illustrates a side elevational view of the quilt holding clamp of the present invention in a closed clamping position.

The "U"-shaped spring 20 includes a center section 22 having top and bottom parallel slots 22*a* and 22*b* (shown in phantom) formed therein. The center section 22 is made of a thin lightweight but sturdy metal material. Integrally formed with the center section 22 are top and bottom spring members 24 and 26 which project from the top and bottom edges, respectively, of the center section 22, as best seen in FIG. 3. The top and bottom spring members 24 and 26 are generally a flat planar substrate made of metal.

In the exemplary embodiment, the "U"-shaped spring 20 is a solid metal piece of material that is bent or curved about elbows A and B wherein the distance between elbows A and B defines the center section 22. The length of the metal between elbow A and the top free end defines the top spring member 24. The length of the metal between elbow B and the bottom free end defines the bottom spring member 26.

In operation, the "U"-shaped spring 20 is spring biased to close together the top clamp member 30 and a bottom clamp member 40, as best seen in FIG. 3. The top clamp member 30 is coupled to the underside of the top spring member 24 and journalled through the top slot 22*a*. The bottom clamp member 40 is coupled to the top side of the bottom spring member 26 and journalled through the top slot 22*b*. The forward end of the top and bottom clamp members 30 and 40 extend through the slots 22*a* and 22*b*, respectively.

In the exemplary embodiment, the spring biasing is created by the obtuse angle of elbows A and B such that the top spring member 24 and the bottom spring member 26 are not parallel. Instead, the free end of the top spring member 24 and the free end of the bottom spring member 26 flare so that the distance between the two is greater than the forward ends of the top and bottom spring members 24 and 26 coupled to elbows A and B, respectively. Thus, the forward ends of the top and bottom clamp members 30 and 40 are sloped together such that they generally touch.

Figure 4:
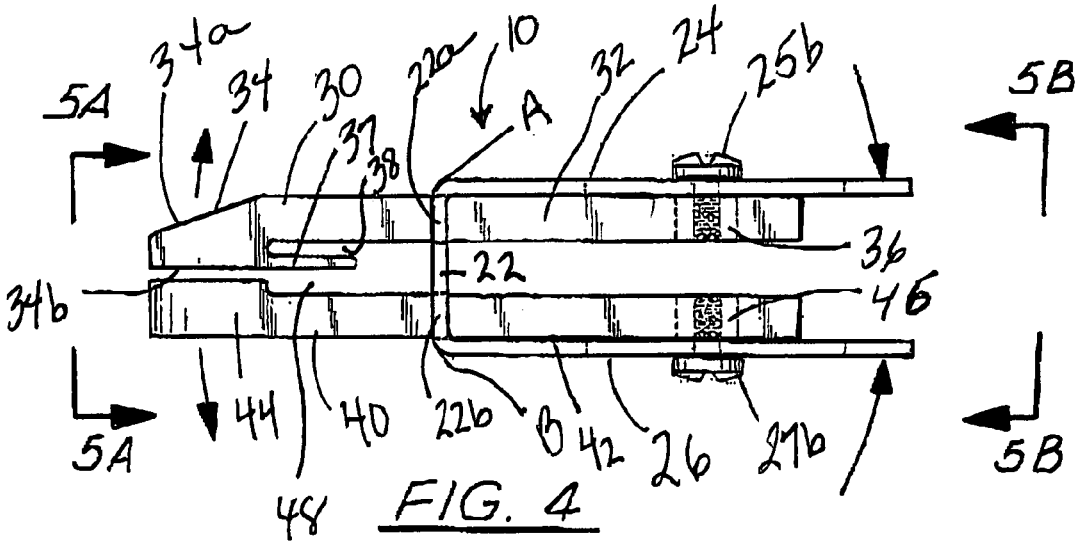
FIG. 4 illustrates a side elevational view of the quilt holding clamp of the present invention showing the opening of the clamp from the closed position.
Figure 5A:
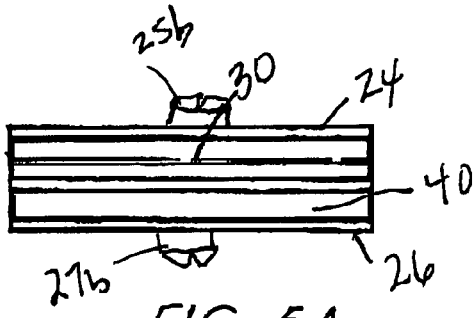
FIG. 5A illustrates a front elevational view along the plane 5A-5A of the embodiment in FIG. 4.
Figure 5B:
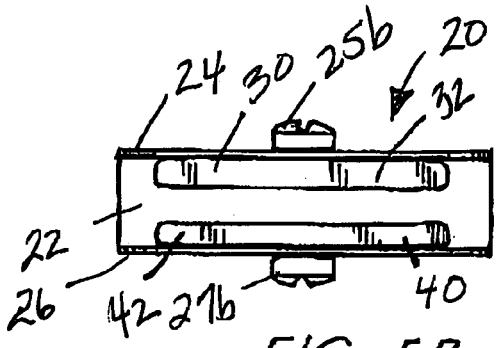
FIG. 5B illustrates a rear elevational view along the plane 5B-5B of the embodiment in FIG. 4.

As best seen in FIG. 4, applying pressure to the top free end of the top spring member 24 and the bottom free end of the bottom spring member 26 reduces the distance between the free ends of the top and bottom spring members 24 and 26. As the distance reduces, the forward ends of the top and bottom clamp members 30 and 40 separate from each other.

Figure 6D:
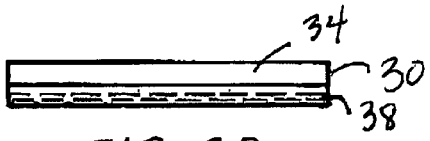
FIG. 6D illustrates a front view of the top clamp member of the quilt holding clamp in accordance with the present invention.
Figure 6A:
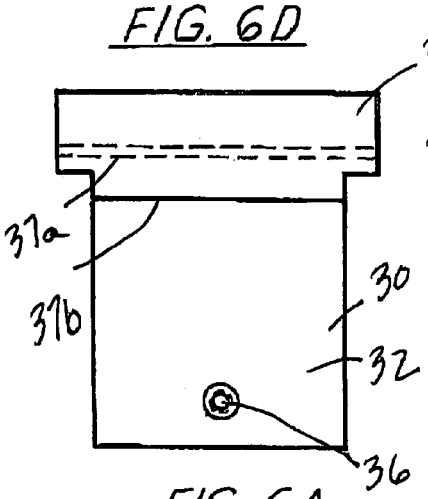
FIG. 6A illustrates a bottom view of the top clamp member of the quilt holding clamp in accordance with the present invention.
Figure 6C:
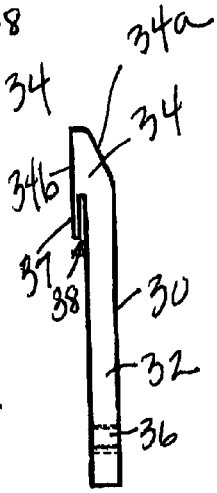
FIG. 6C illustrates a side view of the top clamp member of the quilt holding clamp in accordance with the present invention.
Figure 6B:
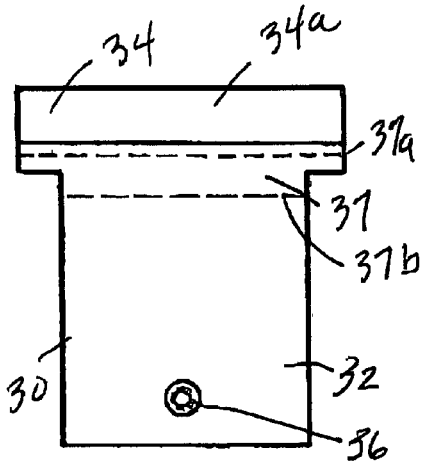
FIG. 6B illustrates a top view of the top clamp member of the quilt holding clamp in accordance with the present invention.
Figure 6E:
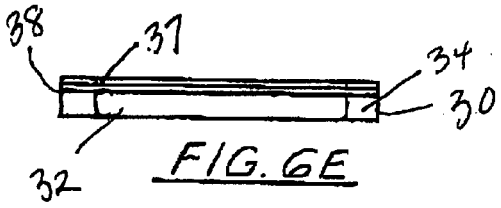
FIG. 6E illustrates a rear view of the top clamp member of the quilt holding clamp in accordance with the present invention.
Figure 7A:
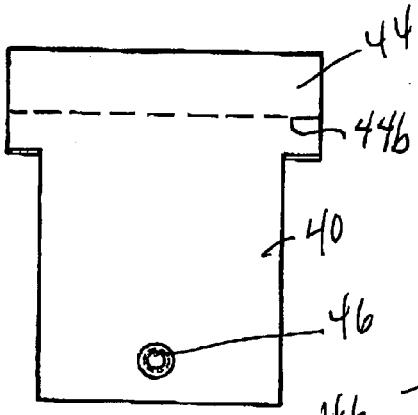
FIG. 7A illustrates a bottom view of the bottom clamp member of the quilt holding clamp in accordance with the present invention.
Figure 7C:
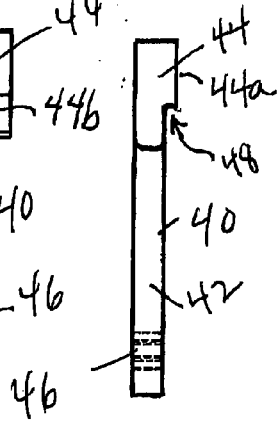
FIG. 7C illustrates a side view of the bottom clamp member of the quilt holding clamp in accordance with the present invention.
Figure 7B:
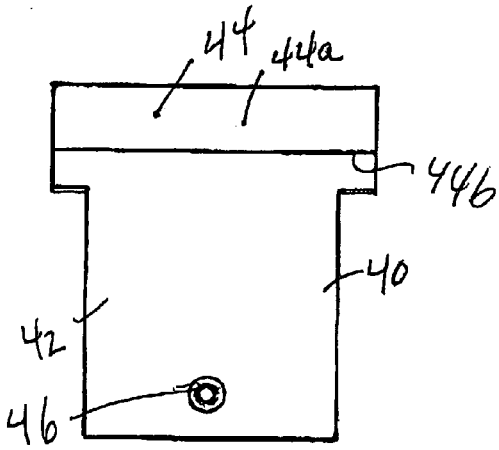
FIG. 7B illustrates a top view of the bottom clamp member of the quilt holding clamp in accordance with the present invention.

In the exemplary embodiment, the top and bottom clamp members 30 and 40 are adjustably coupled to the top and bottom spring members 24 and 26. The top spring member 24 has formed therein a channel 25*a* that receives a screw 25*b*. The screw 25*b* is adapted to be attached to the top clamp member 30, as best seen in FIGS. 6A-6C. Likewise, the bottom spring member 26 has formed therein a channel 27*a* that receives a screw 27*b*. The screw 27*b* is adapted to be attached to the bottom clamp member 30, as best seen in FIGS. 7A-7C. The details of adjustment will be described in relation to the operation of the quilt holding clamp 10.

Referring now to FIGS. 6A-6E, the top clamp member 30 includes a parallelogram member 32 that has integrally formed therewith a "J"-shaped forward end 34. The "J"-shaped forward end 34 is wider with than the parallelogram member 32, as best seen in FIGS. 6A and 6B. The parallelogram member 32 is adjustable and fits and slides within the top slot 22*a* of the "U"-shaped clamp 20. Furthermore, the parallelogram member 32 has formed therein a threaded aperture 36 for receiving the screw 25*b*.

Tightening the screw 25*b* tightly sandwiches the top clamp member 24 between the screw head and the parallelogram member 32 and secures the top clamp member 30 in place. Loosening the screw 25*b* enables the screw 25*b* to move along the length of channel 25*a*. Thereby, the parallelogram member 32 and thus the "J"-shaped forward end 34 can be slid back or forward.

In the preferred embodiment, the "J"-shaped forward end 34 includes a top sloped surface 34*a* and a generally flat bottom surface 34*b* that is parallel with the bottom surface of the parallelogram member 32 but not aligned therewith. The "J" shape is created by the formation of a channel 38 formed between the flat bottom surface 34*b* and the bottom surface of the parallelogram member 32. The channel 38 creates a overhang 37, between lines 37*a* and 37*b*, parallel with the parallelogram member 32 and aligned or integrally formed with the flat bottom surface 34*b*. Line 37*a* defines the end of the channel 38 where the fold of the folded end 5*b* of the finishing bias 5 should be slid. Line 37*b* illustrates the end of the overhang 37 and thus end of channel 38.

Channel 38 is adapted to receive therein the folded end 5*b* of the finishing bias 5. Sliding the "J"-shaped forward end 34 allows the folded end 5*b* of the finishing bias 5 to be moved or slid into the channel 38. Nevertheless, the folded end 5*b* of the finishing bias 5 can be threaded into the channel 38 without sliding the "J"-shaped forward end 34.

Referring now to FIGS. 7A-7C, the bottom clamp member 40 includes a parallelogram member 42 that has a "L"-shaped forward end 44 that is integrally formed therewith. The "L"-shaped forward end 44 is wider with than the parallelogram member 42, as best seen in FIGS. 7A and 7B. The parallelogram member 42 is adjustable and fits and slides within the bottom slot 22*b* of the "U"-shaped clamp 20. Furthermore, the parallelogram member 42 has formed therein a threaded aperture 46 for receiving the screw 27*b*.

Tightening the screw 27*b* tightly sandwiches the bottom clamp member 26 between the screw head and the parallelogram member 42 and secures the bottom clamp member 40 in place. Loosening the screw 27*b* enables the screw 27*b* to move along the length of channel 27*a*. Thereby, the parallelogram member 42 and thus the "L"-shaped forward end 44 can be slid back or forward to adjust for the seamline.

Figure 8:
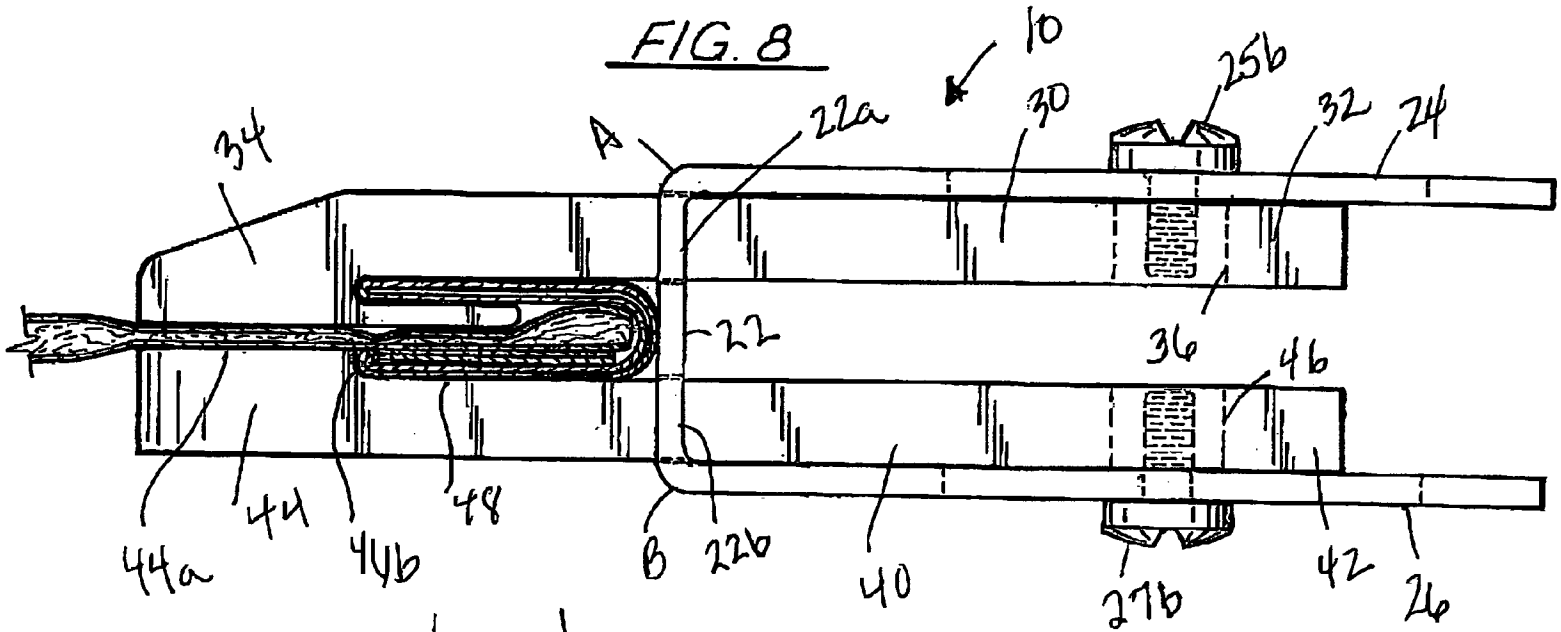
FIG. 8 illustrates a side perspective view of the quilt holding clamp in accordance with the present invention clamping a quilt and folding the finishing bias; and, FIGS. 9A-9C illustrates the steps of sewing finishing bias to an unfinished edge of a quilt.

The "L"-shaped forward end 44 includes a raised forward area that is flat and aligned with the flat bottom surface 34*b* of the "J"-shaped forward end 34. The raised forward area is hereinafter referred to as the "flat raised surface 44*a*". The flat raised surface 44*a* is raised above the plane of the parallelogram member 42 and creates a recess 48 for the receipt of the four (4) layers of finishing bias 5, as best seen in FIG. 8. Moreover, edge defined by line 44*b* creates a seam aligner for adjusting the "L"-shaped forward end 44.

Figure 9A:
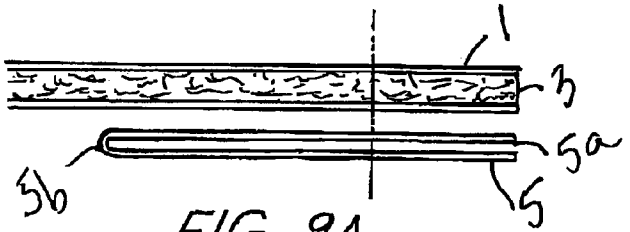
Figure 9C:
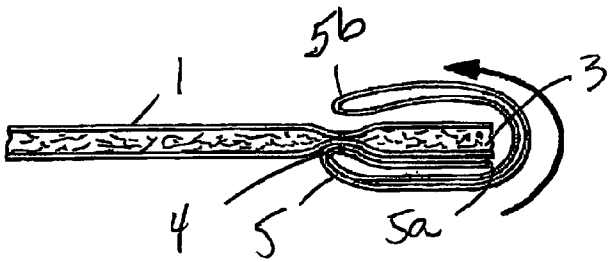
Figure 9B:
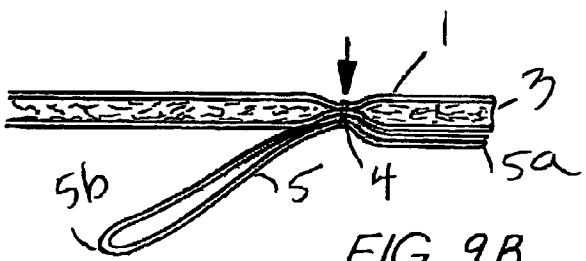

Regarding FIGS. 9A-9C, the general method of sewing finishing bias 5 to an unfinished edge 3 of quilt 1 is shown. The finishing bias 5 is generally folded evenly in half so that the inside unfinished sides of the finishing bias material are in contact. As best seen in FIG. 9A, the unfinished ends 5*a* of the folded finishing bias 5 is aligned with the unfinished edge 3 of quilt 1.

Referring now to FIG. 9B, the a seam 4 is created when finishing bias 5 is sewn directly to one side of the quilt 1 wherein the unfinished edge 5*a* of the finishing bias 5 aligned with the quilt's unfinished edge 3. The folded end 5*b* of the finishing bias 5 can be laid flat on top of the quilt 1 during sewing. The seam width is approximately ⅝ of and inch. Nevertheless, other seam widths can be used as desired. In the exemplary embodiment, the finishing bias 5 is first sewn to the top side of quilt 1.

Referring now to FIG. 9C, the remaining finishing bias 5 is looped around the quilt's unfinished edge 3. Typically, the seamstress will then pin the looped over finishing bias to the bottom of the quilt 1. After the pining is complete, the seamstress can sew by hand the looped over finishing bias about the folded end 5*b*.

Referring now to FIG. 8, the quilt holding clamp 10 eliminates the need to pin the looped over finishing bias 5. Pinning is tedious and time consuming. Moreover, since many older women quilt, arthritis can be a deterrent from quilting because of the need to pin the finishing bias 5.

In operation, after the seam 4 is sewn (FIG. 9B), the edge defined by line 44*b* of the "L"-shaped forward end 44 is aligned with seam 4 by loosening the screw 27*b* and sliding the "L"-shaped forward end 44 into alignment. Thereafter, the screw 27*b* is tightened to secure the "L"-shaped forward end 44.

In view of the foregoing, the recess 48 is adjusted to the length of the seam width including the thickness of the looped over thickness of the finishing bias 5, as best seen in FIG. 8. The length of the recess 48 is adjusted based on the distance between center section 22 and line 44*b* (edge). As seen in FIG. 8, four (4) layers of the finishing bias is recessed in recess 48 to minimize bunching or misalignment during operation of the quilt holding clamp 10.

Next, the "J"-shaped forward end 34 and thus the top clamp member 30 is moved forward by loosening screw 25*b* and sliding the top clamp member 30 forward. The folded end 5*b* is pulled forward and oriented as it would normally for pinning to eliminate gaps, bunching, etc. By slightly lifting the folded end 5*b* and moving the "J"-shaped forward end 34 backward, the folded end 5*b* is slid into channel 38. The "J"-shaped forward end 34 is moved backward until the folded end 5*b* adjacent to, in close proximity to, or touches the forward end of channel 38 at line 37*a*. Thus, the folded end 5*b* is elevated above the quilt 1.

The top and bottom clamp members 30 and 40 are made of a lightweight smooth plastic that is adapted to be easily slid along the quilt 1. In the preferred embodiment, the plastic is slightly transparent to allow the seamstress to observe the alignment of seam 4 along the edge 44*b* and the folded end 5*b* in channel 38. Preferably, the top and bottom clamp members 30 and 40 automatically oriented to a clamping position as the result of the biasing of the "U"-shaped spring 20. Nevertheless a tighter hold can be created by holding together the "J"-shaped and "L"-shaped forward ends 34 and 44, as the quilt holding clamp 10 is slid along the edge of quilt 1. The tighter hold is needed as the quilt holding clamp 10 is slid along the edge of quilt 1 as a another length of the folded end 5*b* needs to be sewn.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A quilt holding clamp for securing a quilt and finishing bias for said quilt comprising:

a top clamp member having a "J"-shaped forward end for elevating a folded end of said finishing bias above said quilt and a back end;

a bottom clamp member a forward end and a back end; and, a "U"-shaped spring biased to close together, about said quilt, said "J"-shaped forward end and said forward end of said bottom clamp member.

2. The clamp of claim 1, wherein the "U"-shaped spring includes:

a center section having top and bottom parallel slots formed therein for sliding therethrough said back ends of the top and bottom clamp members; and, top and bottom spring members which project from top and bottom edges, respectively, of the center section wherein said back ends of said top and bottom clamp members track said top and bottom spring members, respectively.

3. The clamp of claim 2, wherein:

a back end of said bottom clamp member comprises:

a parallelogram member; and, said forward end comprises a "L"-shaped forward end integrally formed with the parallelogram member wherein the "L"-shaped forward end includes a raised flat surface and a recess for recessing a plurality of layers of finishing bias while said raised flat surface and said "J"-shaped forward end of said top clamp member clamp said quilt.

4. The clamp of claim 3, wherein said bottom clamp member is made of a smooth plastic that is slightly transparent to enable a seamstress to inspect alignment of a seam securing said quilt and said finishing bias together with an edge of said raised flat surface.

5. The clamp of claim 3, wherein:

said "J"-shaped forward end is adjustable with respect to its distance from said "U"-shaped spring; and said "L"-shaped forward end is adjustable with respect to its distance from said "U"-shaped spring.

6. The clamp of claim 5, wherein:

said adjustment of said "L"-shaped forward end increases or decreases a length of said recess.

7. The clamp of claim 1, wherein said "J"-shaped forward end comprises a channel to receive of a folded end of said finishing bias.

8. The clamp of claim 7, wherein said top clamp member is made of a smooth plastic that is slightly transparent to enable a seamstress to inspect said folded end of said finishing bias in said channel of said "J"-shaped forward end.

9. A method of attaching a finishing bias to an unfinished edge of a quilt using a quilt holding clamp comprising the steps of:

sewing the folded in half finishing bias to a first side of the quilt to create a seam and to attach a unfinished end of the finishing bias to the quilt;

aligning the seam in a recess of a bottom clamp member of the quilt holding clamp wherein the recess is adapted to recess multiple layers of said finishing bias;

feeding a folded end of said finishing bias in a channel of a top clamp member of the quilt holding clamp; and, sewing by hand the folded end of the finishing bias to the quilt.

10. The method of claim 9, wherein:

said top clamp member is made of a smooth plastic that is slightly transparent; and the feeding step includes the step of:

inspecting alignment of said folded end of said finishing bias in said channel.

11. The method of claim 10, further comprising the step of:

adjusting said top clamp member of the quilt holding clamp wherein to slide said folded end into said channel until said folded end is fully reach in said channel during said feeding step; and, after the adjusting step, securing said top clamp member.

12. The method of claim 9, wherein:

said bottom clamp member is made of a smooth plastic that is slightly transparent; and, said aligning step includes the step of:

inspecting alignment of the seam.

13. The method of claim 9, further comprising the step of:

adjusting said bottom clamp member of the quilt holding clamp wherein to increase or decrease said recess to when aligning said seam; and, after the adjusting step, securing said bottom clamp member.

14. The method of claim 9, further comprising the step of:

during the sewing step, intermittently sliding the quilt holding clamp along said quilt to sew another length of said folded end of said finishing bias to said quilt.

15. A quilt holding clamp for securing a quilt and finishing bias for said quilt comprising:

a top clamp member having a "J"-shaped forward end and a back end;

a bottom clamp member a "L"-shaped forward end and a back end; and, a "U"-shaped spring biased to close together, about said quilt, said "J"-shaped forward end and said "L"-shaped forward end of said bottom clamp member.

16. The clamp of claim 15, wherein the "U"-shaped spring includes:

a center section having top and bottom parallel slots formed therein for sliding therethrough said back ends of the top and bottom clamp members; and, top and bottom spring members which project from top and bottom edges, respectively, of the center section wherein said back ends of said top and bottom clamp members track said top and bottom spring members, respectively.

17. The clamp of claim 16, wherein:

a back end of said bottom clamp member comprises:

a parallelogram member; and, said "L"-shaped forward end is integrally formed with the parallelogram member wherein the "L"-shaped forward end includes a raised flat surface and a recess for recessing a plurality of layers of finishing bias while said raised flat surface and said "J"-shaped forward end of said top clamp member clamp said quilt.

18. The clamp of claim 17, wherein said bottom clamp member is made of a smooth plastic that is slightly transparent to enable a seamstress to inspect alignment of a seam securing said quilt and said finishing bias together with an edge of said raised flat surface.

19. The clamp of claim 15, wherein:

said "J"-shaped forward end is adjustable with respect to its distance from said "U"-shaped spring; and said "L"-shaped forward end is adjustable with respect to its distance from said "U"-shaped spring.

20. The clamp of claim 15, wherein said "J"-shaped forward end comprises a channel to receive of a folded end of said finishing bias.

* * * * *